United States Patent [19]

Miller

[11] 4,161,821

[45] Jul. 24, 1979

[54] SCRIBING TOOL FOR MARKING WALL PANELS FOR CUTTING TO FIT THE CONTOUR OF A WALL CORNER

[76] Inventor: Charles W. Miller, 814 N. 8th St., Springfield, Ill. 62702

[21] Appl. No.: 841,739

[22] Filed: Oct. 13, 1977

Related U.S. Application Data

[63] Continuation-in-part of Ser. No. 680,468, Apr. 26, 1976, abandoned.

[51] Int. Cl.[2] ..... B43L 13/02

[52] U.S. Cl. ..... 33/41 R

[58] Field of Search ..... 33/41 R, 41 C, 41 E, 33/42, 27 K

[56] References Cited

U.S. PATENT DOCUMENTS

| | | | |
|---|---|---|---|
| 647,070 | 4/1900 | Black | 33/41 D |
| 810,246 | 1/1906 | Anderson | 33/42 |
| 1,678,620 | 7/1928 | Baker | 33/42 |
| 2,314,327 | 3/1943 | Drake | 33/27 K |
| 2,514,003 | 7/1950 | Martin | 33/41 R |
| 2,782,506 | 2/1957 | Igram | 33/41 R |
| 2,958,133 | 11/1960 | Seitz | 33/42 |
| 3,516,167 | 6/1970 | McCain | 33/41 R |

FOREIGN PATENT DOCUMENTS

| | | | |
|---|---|---|---|
| 188110 | 2/1956 | Austria | 33/42 |
| 110986 | 7/1925 | Switzerland | 33/41 E |

*Primary Examiner*—Charles E. Phillips

*Attorney, Agent, or Firm*—Ralph F. Staubly

[57] ABSTRACT

A scribing tool for marking wall panels for cutting them to fit the contour of a wall corner. The tool body has either a flat face or a rotating roller for engaging the corner wall surface that is perpendicular to the wall being paneled. The tool body carries a scribing element or pencil. In one species the scribing element is axially adjustable in a selected one of intersecting V-grooves in the top surface of the tool body, and a flat face is perpendicularly movable relatively to the tool body by being on the vertical face of an L-shaped strap whose medially slotted lower reach underlies the tool body. In a second species the scribing tool is axially adjustable in a V-groove in the upper surface of a disc rotatably mounted on the top surface of the tool body. In both flat-faced species, a rod passing vertically through the tool body clamps the scribing element and the adjustable body part in their adjusted positions by means of a nut on its threaded lower end. In a third species a roller is mounted on an axle pin fixed to a handle at an angle of 45 degrees. The axle pin terminates in a conical scriber point and is spring-retractable into the roller across the plane of its wall-engaging flat face. When the handle is held horizontally its center line passes close to the intersection line of the corner wall surfaces. A pair of sheet-metal gages having panel-gripping pockets of a depth equal to the amount of a preselected panel overlap, and also equal to the scriber-tool setting, are desirably employed.

6 Claims, 7 Drawing Figures

SCRIBING TOOL FOR MARKING WALL PANELS FOR CUTTING TO FIT THE CONTOUR OF A WALL CORNER

This application is a continuation-in-part of applicant's now-being-abandoned identically entitled application Ser. No. 680,468 filed Apr. 26, 1976, now abandoned.

BACKGROUND AND OBJECTS OF THE INVENTION

Heretofore, panels have been marked for cutting to fit the contour of corners by plumbing a panel close to a corner and then using a common pair of compasses for scribing a line at a selected contour distance from the wall being abutted. This operation required that the scribing tool be moved with its points accurately held in horizontal planes, a difficult feat.

It is accordingly the principal object of the present invention to provide a scribing tool that automatically holds its scribing point at a preselected set distance from a wall.

It is another object to provide a scribing kit that includes such a tool plus a pair of gages for accurately gaging panel overlap for a wall-completing corner panel being scribed.

Other objects and advantages will become apparent as the following description proceeds.

DETAILED DESCRIPTION

Figure 1:
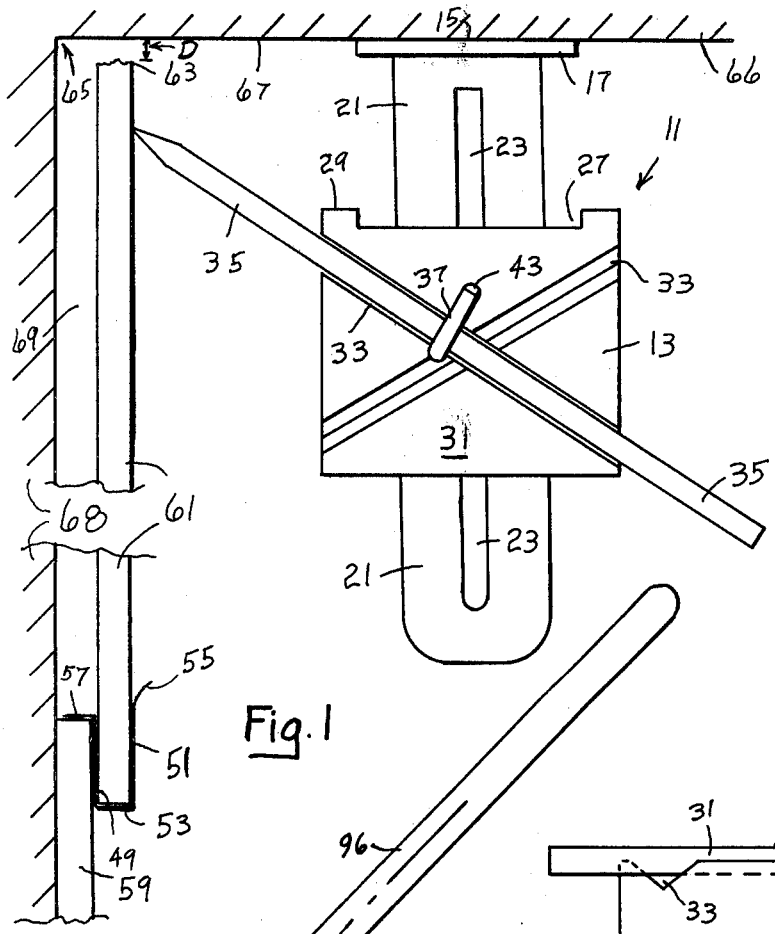
FIG. 1 is a plan view of a preferred embodiment of the invention.
Figure 2:
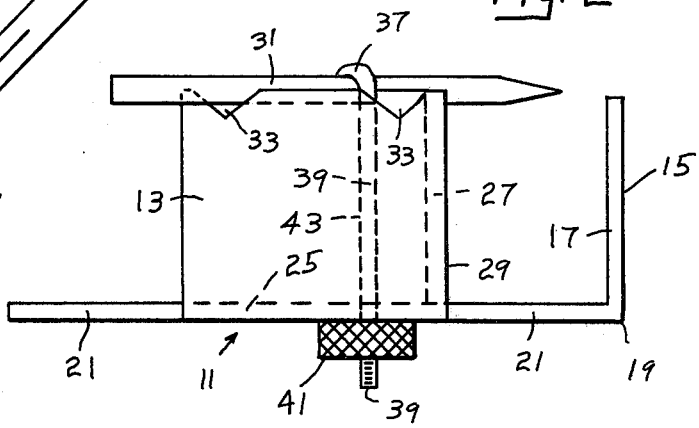
FIG. 2 is an elevational view of the tool of FIG. 1 as seen from the right side of FIG. 1.

With reference now to FIGS. 1 and 2 of the drawings, the numeral 11 generally designates the first species of the scribing tool. The tool 11 comprises a body 13 of metal (e.g. aluminum) or molded plastic material. The body 13 has a wall-engaging flat face 15 formed primarily by the vertical reach 17 of an L-shaped strap 19 constituting a movable body element. The strap 19 has a horizontal reach 21 medially slotted at 23 for a purpose later described. The reach 21 is guided in a shallow channel 25 formed in the bottom surface of the body 13. The reach 17 can be flushly stored in a shallow recess 27 in the wall-facing surface 29 of the body 13.

The top surface 31 of the body 13 is provided with at least two intersecting V-shaped grooves 33 for alternate reception of a scribing element 35 for marking to the left of the body 13 (as in FIG. 1) or to the right thereof (not shown). The scribing element 35 is held clamped in one groove 33 by the hooked upper end 37 of a rod 39 threaded at its lower end to receive a nut 41. The rod 39 passes vertically through a bore 43 in the body 39 and through the slot 23 in the L-shaped strap 19, whereby tightening of the nut 41 will hold both the scribing element 35 and the L-shaped strap 19 in their adjusted positions.

Figure 7:
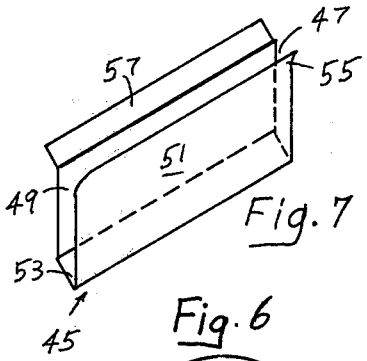
FIG. 7 is a perspective view of a panel-overlap gage usable with either form of the tool.

FIG. 7 shows an overlap gage 45 formed of rigid sheet material, shaped to provide a panel-thickness pocket 47. The pocket 47 is formed by a rear wall 49, a front wall 51 and a bottom wall 53. The front wall 51 has a placement-facilitating curved lip 55. The rear wall 49 has an out-turned upper flange 57 engageable over the vertical edge of a previously installed wall panel 59. The pocket 47 has a depth to provide an overlap of, for example one or two inches, between the installed panel 59 and the panel 61 (roughly pre-cut at 63) to be installed in the corner 65 formed by the wall sections 66 and 68.

In use of the tool 11 and a pair of overlap gages 45, each having for example two-inch pocket depths, the panel 61 is roughly cut at 63 of a width so as to overlap the panel 59 by two inches but so as not to bindingly engage the to-be-abutted irregular wall surface 67 at the most buidging point of its contour (that is by being averagely spaced by distance D). Then two gages 43 are clipped at vertically widely spaced points to the uncut straight edge of the roughly cut panel 61, and the panel 61 is positioned as shown in FIG. 1. Next the scribing tool 11 is so adjusted that its scribing point is located two inches from the plane of the face 15. Then the tool is placed as shown in FIG. 1 and is moved to scratch (or mark if a pencil is used) a vertical line having a contour matching that of the wall surface 67 close to the corner 65. Finally, the panel 61 is cut along the vertical line, and the cut panel is inserted snugly into the space 69.

Figure 3:
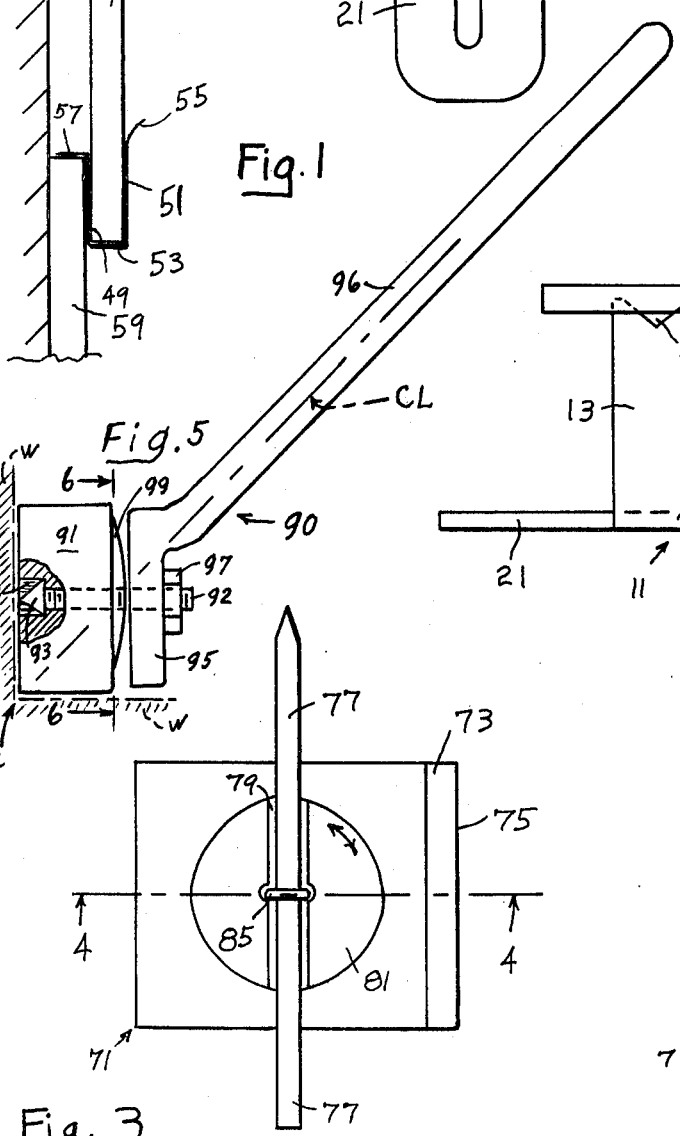
FIG. 3 is a plan view of a second species of the invention.
Figure 4:
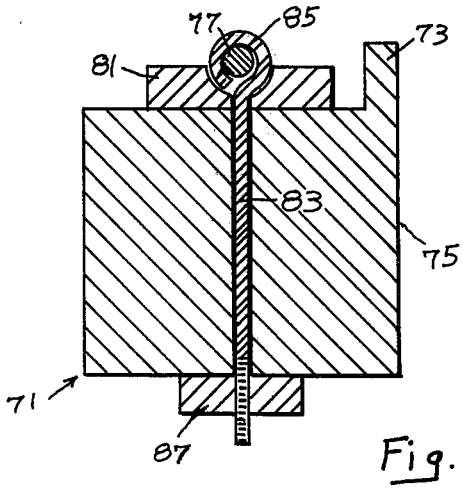
FIG. 4 is an elevational view of the tool of FIG. 3 in section taken on the line 4—4 of FIG. 3.

With reference now to the species of FIGS. 3 and 4, the numeral 71 generally designates the body of the scribing tool. The body 71 preferably, but not necessarily, has an integral flange 73 which extends the wall-engaging flat face 75 of the body 71 upwardly to or above the plane of the horizontally rotated scriber-element point. The scribing element 77 lies in a V-shaped groove 79 in a disc 81 rotatable about a rod 83. The rod 83 passes through a vertical bore in the body 71 and has an eye 85 formed at its upper end to loosely receive the scribing element (or pencil) 77. The lower end of the rod 83 is threaded to receive a nut 87. Tightening the nut 87 clamps the scribing element in its radially adjusted position, and both it and the disc 81 in their rotated angular positions.

Figure 6:
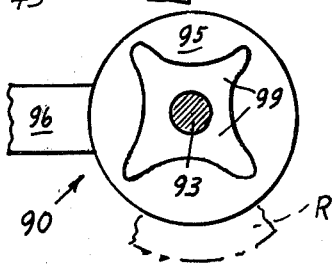
FIG. 6 is an elevational view of the showing of FIG. 5 in section taken on the line 6—6 by FIG. 5.
Figure 5:
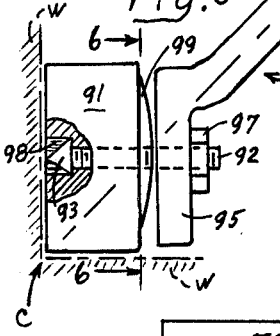
FIG. 5 is a plan view of a third species of the invention.

With reference now to FIGS. 5 and 6, the numeral 90 generally designates a roller species of the invention, which comprises a roller 91 engageable into a wall corner C. The roller 91 is mounted on an axle pin 92 having a roller-retaining enlarged head 93 terminating in a conical scriber point 94. The axle pin 92 is threaded on its rear end for adjustable and replaceable reception in a tapped bore in the angled flat end 95 of the handle 96. A locking nut 97 fixes the axle pin in adjusted position with its conical head 93 retracted into the countersunk bore 98 by the force of a radial-armed dished spring 99.

The spring 99 permits a spring-flattening force, exerted through the handle axially of the scriber element 92, to protrude the scriber point sufficiently beyond the wall-engaging face of the roller to produce the desired scribing as the roller is moved up and/or down in the wall corner.

The handle 96 is preferably wider than thick (as shown by the plan view of FIG. 5 and the elevational view of FIG. 6) for more firm, comfortable, and steady gripping; and the angle between the handle and the face of the roller is approximately 45 degrees, that is for example 45 degrees plus or minus five degrees, (1) to make the forces against each corner wall approximately equal, (2) to provide the same handling "feel" for scribing either the right or the left wall of a corner, and (3) to be equally adapted to right-handed or left-handed use. Further, for a well-balanced handling "feel" it is desirable that the centerline CL of the horizontally held handle should pass close to the corner line of the intersecting walls as shown in FIG. 5. The diameter of the roller 91 can be increased by press-fitting thereon a ring R (fragmentally shown in phantom in FIG. 6).

For installing a first panel into and away from a corner, the overlap gages 45 are not used. Instead, a panel is placed as close to the corner as is consistent with its side edges being plumb. The scriber is then set to produce a full-length contour-following mark close to the corner-receivable panel edge.

The invention having been described what is claimed as being patentable is:

1. A scribing tool for marking a being-installed wall panel for cutting said panel to fit the contour of a wall corner, said tool comprising: a roller disc having a cylindrical peripheral surface and having a flat surface perpendicular to the axis of said cylindrical surface, a shaft journaled in an axial bore in said disc and carrying a scribing point protruding axially at least slightly beyond said flat surface for marking a cut-guiding line on a panel held flatwise against one wall with said panel's edge close to the corner defined by said one wall and by another intersecting wall at right angle thereto when said flat face of said disc is pressed against said one wall and said cylindrical surface is rolled against said another wall, and a manipulating handle fixed to said shaft at an angle of approximatley 45 degrees to the axis of said shaft and with its center line oriented during a scribing operation to pass close to the intersection line of said walls for firm-pressure engagement therewith.

2. Structure according to claim 1, said handle being substantially wider than thick for improved handling and comfort.

3. Structure according to claim 1, said disc being adapted for limited axial movement relative to said scribing element, and said tool additionally comprising resilient means for yieldably retractably urging said scribing element away from said flat surface of said disc.

4. Structure according to claim 3, said scribing element being threadedly connected to said body for adjustment, repair or replacement, and said resilient means being a sheet-type compression spring.

5. Structure according to claim 1 and additionally comprising an annular band fittable over said disc to increase its diameter as desired.

6. Structure according to claim 1 and in combination with at least one panel-overlap gage comprising a relatively rigid piece of sheet material bent to have two substantially parallel reaches to embrace the edge of an overlapped panel and a short out-turned edge to engage the edge of the overlapped installed panel, the depth of the pocket between said parallel reaches being equal to the distance between the point of the scribing element and the plane engageable by the periphery of said disc in operatively spacing said scribing element from the wall surface not being marked thereby.

* * * * *